US006837416B2

(12) United States Patent
Yu

(10) Patent No.: US 6,837,416 B2
(45) Date of Patent: Jan. 4, 2005

(54) ELECTRIC STAPLING DEVICE

(76) Inventor: Chung Cheng Yu, 13F No. 1086, Chung-Ming S. Rd., Taichung City (TW)

( * ) Notice: Subject to any disclaimer, the term of this patent is extended or adjusted under 35 U.S.C. 154(b) by 0 days.

(21) Appl. No.: 10/356,568

(22) Filed: Feb. 3, 2003

(65) Prior Publication Data

US 2003/0160083 A1 Aug. 28, 2003

(30) Foreign Application Priority Data

Feb. 27, 2002 (TW) ..... 91202582 A

(51) Int. Cl.[7] ..... B25C 5/06

(52) U.S. Cl. ..... 227/131; 227/86; 227/93; 227/155

(58) Field of Search ..... 227/86, 93, 97, 227/131, 155

(56) References Cited

U.S. PATENT DOCUMENTS

| | | | | | |
|---|---|---|---|---|---|
| 4,640,452 | A | * | 2/1987 | Matt et al. | 227/131 |
| 5,106,066 | A | * | 4/1992 | Shea et al. | 227/131 |
| 5,133,493 | A | * | 7/1992 | Russel et al. | 227/155 |
| 5,230,457 | A | * | 7/1993 | Hiroi et al. | 227/131 |
| 5,586,710 | A | * | 12/1996 | Golicz | 227/155 |
| 5,788,139 | A | * | 8/1998 | Sikora | 227/88 |

* cited by examiner

*Primary Examiner*—Scott A. Smith
(74) *Attorney, Agent, or Firm*—Rosenberg, Klein & Lee

(57) ABSTRACT

A stapling device includes a wire fed in the casing of the device and a staple-bending member is movably connected to a base in the casing and has two protrusions extending from a lower end thereof. An ejecting member movably connected to the base. A mechanism is driven by an activation member and lowers the staple-bending member and the ejecting member to deform a section of the metal wire to be a staple which is ejected through an aperture to staple a pile of document.

3 Claims, 7 Drawing Sheets

ELECTRIC STAPLING DEVICE

FIELD OF THE INVENTION

The present invention relates to an electric stapling device that includes a roll of metal wire which is pressed into staples in the device for stapling documents.

BACKGROUND OF THE INVENTION

A conventional stapling device includes a staples receiving box which is received in the stapling device and receives staples therein. The staples are made to be ready for use when being bought and each staple is in a form of U shape. The staples are injected one at a time to by pushing an arm of the stapling device. The users have to re-load the staples because the staples run out within a short period of time. It takes a lot of labor to staple a lot mount of documents so that an electric stapling device is developed which staple the documents automatically when the documents is put on the platform of the electric stapling device. Nevertheless, the staples run out quickly and the users still re-load the staples frequently.

SUMMARY OF THE INVENTION

The present invention relates to an electric stapling device which comprises a casing having a platform with a slot defined therebetween and a switch is located in the slot. An activation member is received in the casing and a link is pivotally connected to an output shaft of the activation member.

A base is located in the casing and a first shaft and a second shaft rotatably extend through the base. A disk is securely connected to the first shaft and a first rod extends from the disk at a distance from the center of the disk. The first rod is pivotally connected to the link. A first gear is mounted to the first shaft and engaged with a second gear mounted to the second shaft.

A first roller is mounted to the first shaft and engaged with a second roller mounted on the second shaft. A staple-bending member is movably connected to the base and has two protrusions extending from a lower end thereof. A groove is defined in the base and an ejecting member is movably received in the groove and located between the base and the staple-bending member. The ejecting member is located in alignment with the aperture of the casing.

A second rod extends from the first roller at a distance from the center of the first roller. A first action member has a first end pivotally connected to the staple-bending member and a second end of the first action member is mounted on the second rod. A second action member has a first end thereof mounted to the second rod and a second end of the second action member is pivotally connected to a first end of the ejection member.

A mandrel is connected to the casing and a metal wire is wrapped around the mandrel. The metal wire extends between the first roller and the second roller and extends transversely through the groove.

The primary object of the present invention is to provide an electric stapling device which makes staples from a metal wire so that the users need not to re-load staples frequently.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
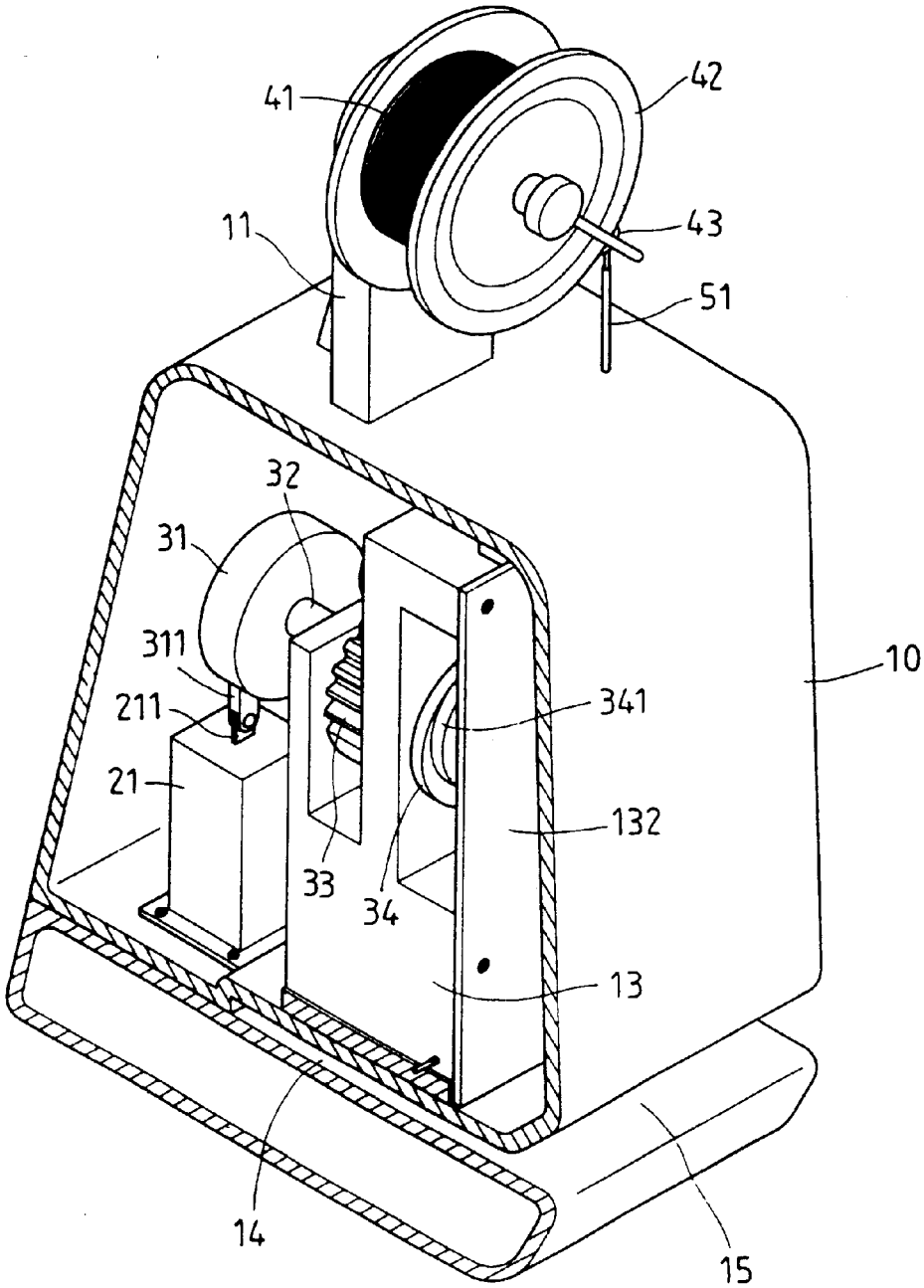
FIG. 1 is a perspective view to show the interior of the stapling device of the present invention.
Figure 2:
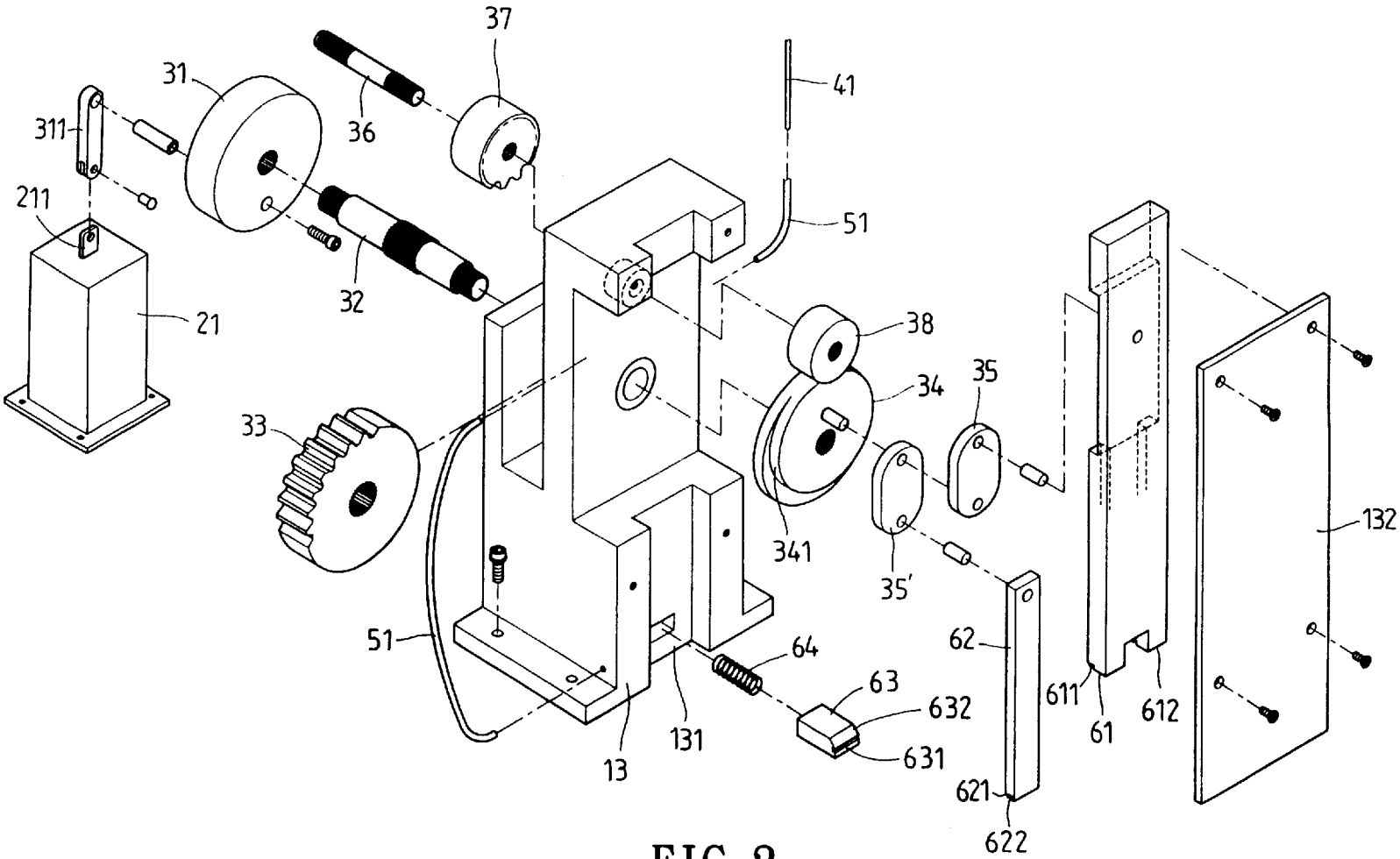
FIG. 2 is an exploded view to show the parts installed in the stapling device of the present invention.
Figure 3:
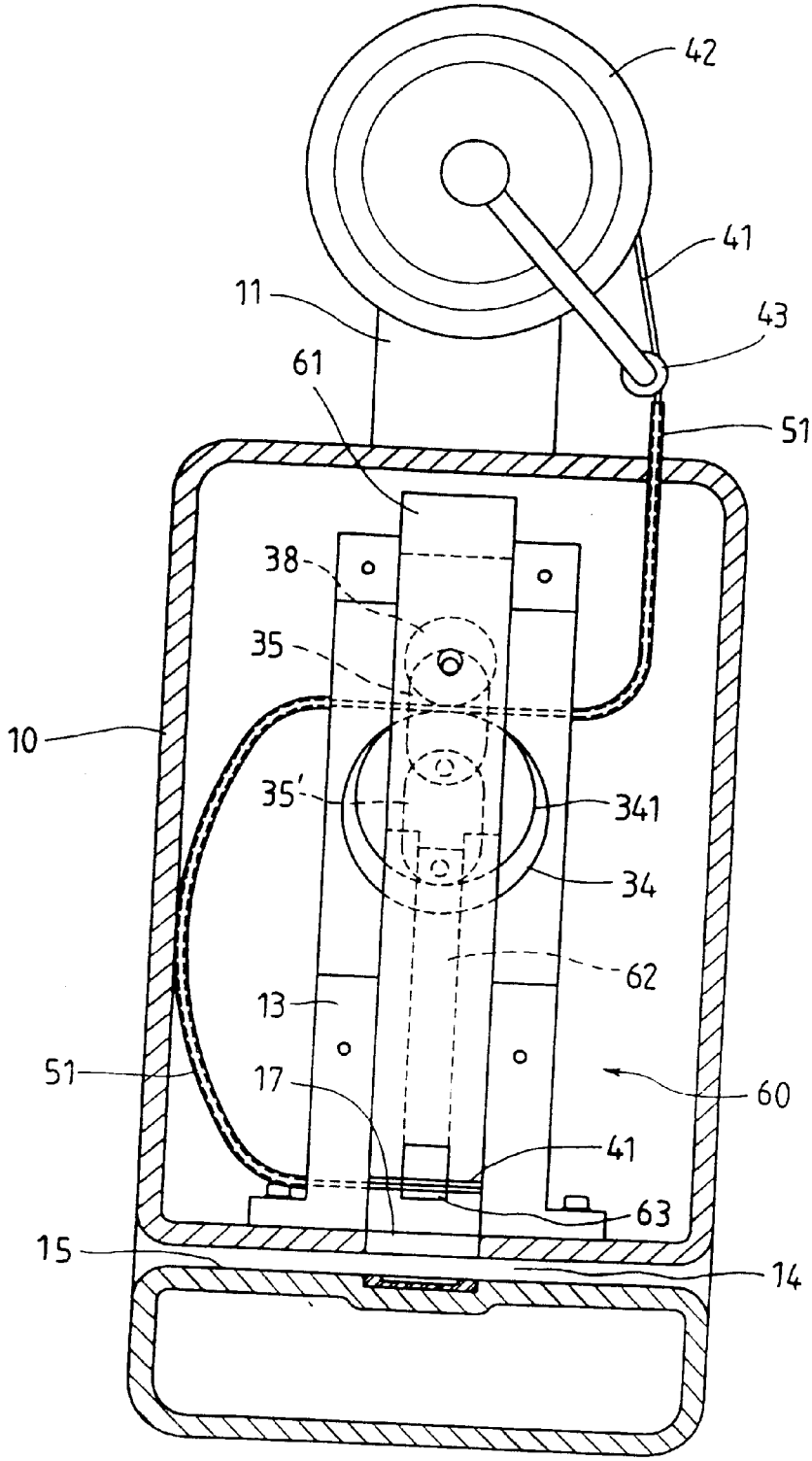
FIG. 3 is a front cross sectional view to show the stapling device of the present invention.
Figure 4:
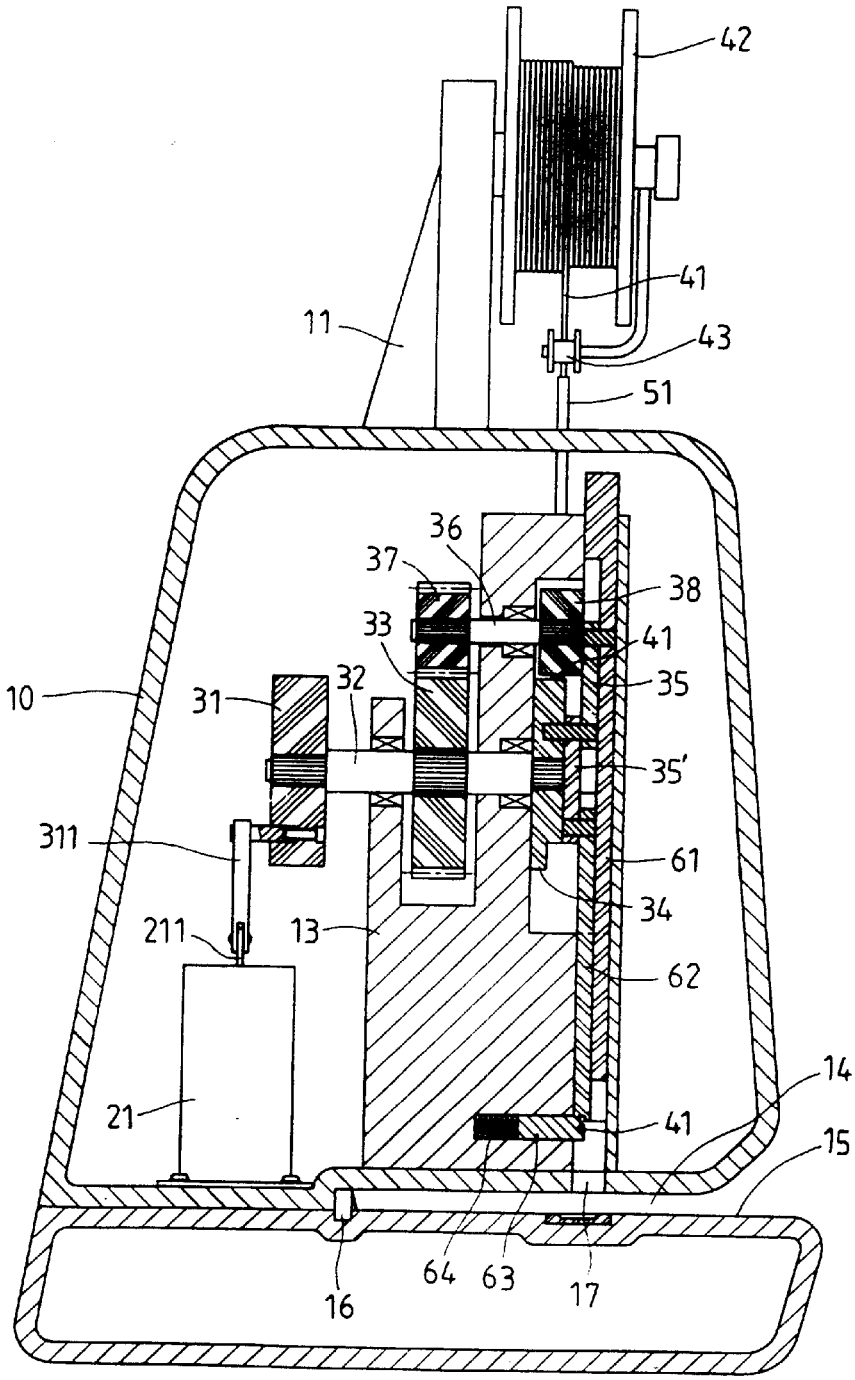
FIG. 4 is a cross sectional view to show the stapling device of the present invention.
Figure 5:
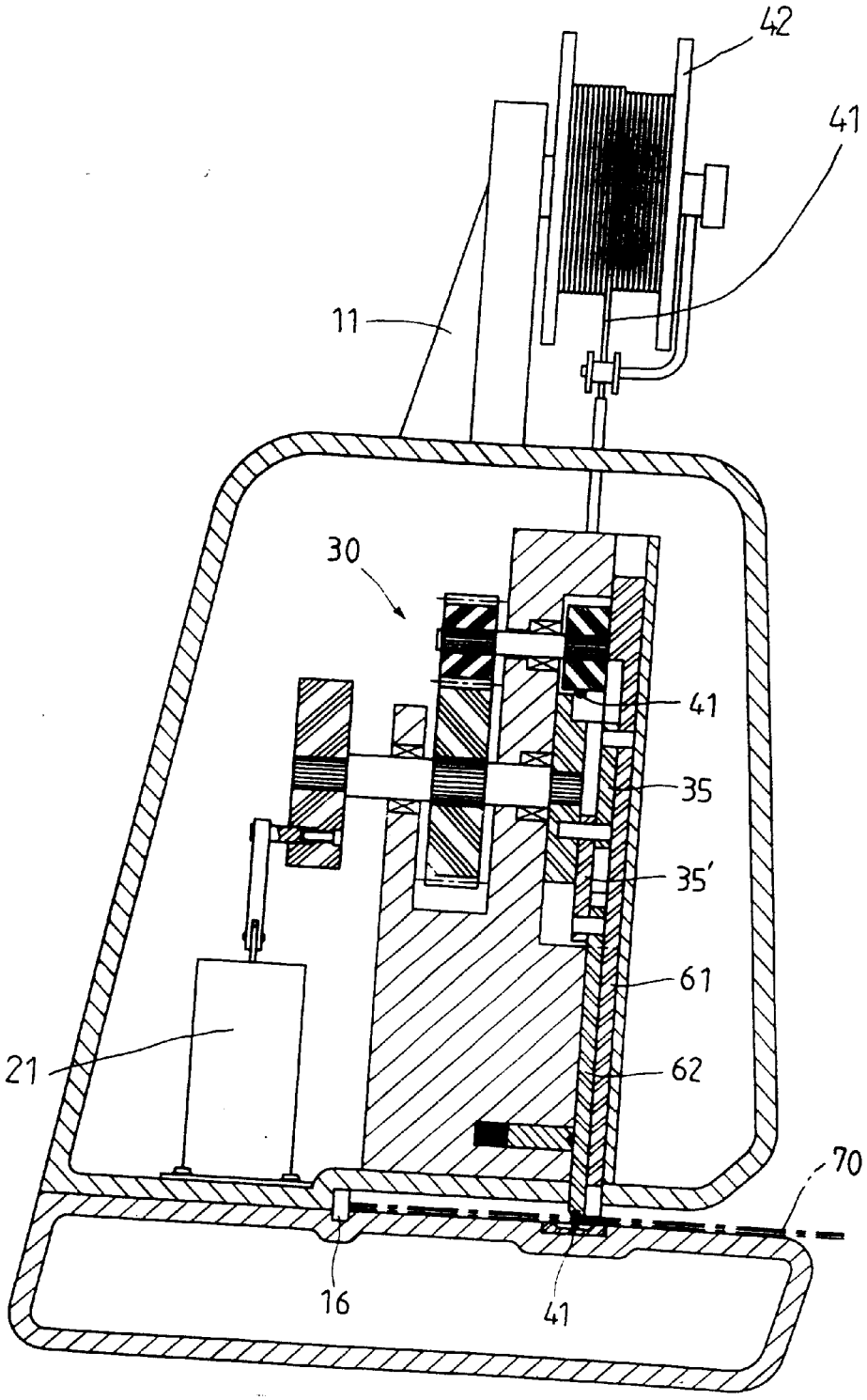
FIG. 5 is a cross sectional view to show the stapling device of the present invention wherein the injecting member is lowered to eject a staple.

Referring to FIGS. 1 to 4, the electric stapling device of the present invention comprises a casing 10 having a platform 15 connected to a lower end thereof and a slot 14 is defined between the casing 10 and the platform 15 so that document is inserted in the slot 14 to be stapled. An aperture 17 is defined through the lower end of the casing 10 and communicates with the slot 14 so that a staple 80 is ejected out from the aperture 17. A switch 16 is located in the slot 14 at the deep end of the slot 14 so that when the document 70 (FIG. 7) contacts the switch 16, the stapling action is activated.

An activation member 21 such as an electro-magnetic switch is received in the casing 10 and a link 311 is pivotally connected to an output shaft 211 of the activation member 21.

A base 13 is located in the casing 10 and a first shaft 32 and a second shaft 36 rotatably extend through the base 13. A disk 31 is securely connected to the first shaft 32 and a first rod extends from the disk 31 at a distance from the center of the disk 31. The first rod is pivotally connected to the link 311. A first gear 33 is mounted to the first shaft 32 and engaged with a second gear 37 mounted to the second shaft 36. A first roller 34 is mounted to the first shaft 32 and engaged with a second roller 38 mounted on the second shaft 36. A staple-bending member 61 is movably connected to the base 13 and has two protrusions 612 extending from a lower end thereof. A cap 132 is connected to the base 13 so as to position the staple-bending member 61. A groove 131 is defined in the base 13 and an ejecting member 62 is movably received in the groove 131 and located between the base 13 and the staple-bending member 61. The ejecting member 62 located in alignment with the aperture 17 of the casing 10. The base 13 has a recess which communicates with the groove 131 and a spring 64 and a block 63 are received in the recess. The block 63 has an inclined surface 632 and a first slit 631. An inclined surface 621 and a second slit 622 is defined in a first end of the ejection member 62 so that when the ejecting member 62 is lowered, the block 63 is pushed toward the recess by the engagement of the two inclined surfaces 632, 621.

A second rod extends from the first roller 34 at a distance from the center of the first roller 34 and the first roller 34 has an eccentric disk 341 extends from a side thereof. A first action member 35 has a first end pivotally connected to the staple-bending member 61 and a second end of the first action member 35 is mounted on the second rod. A second action member 35' has a first end thereof mounted to the second rod and a second end of the second action member 35' is pivotally connected to a second end of the ejection member 62.

A mandrel 42 is connected to a frame 11 on the top of the casing 10 and a metal wire 41 is wrapped around the mandrel 42. A roller 43 assists the metal wire 41 to extend into the casing 10 and passes between the first roller 34 and the second roller 38. A portion of an outer periphery of the eccentric disk 341 contacts the metal wire 41 periodically when the first roller 34 rotates. A first section of tube 51 is inserted into the casing 10 and the metal wire 41 extends through the first section of tube 51. A second section of tube 51 is located in the casing 10 and located beside the base 13.

Figure 6:
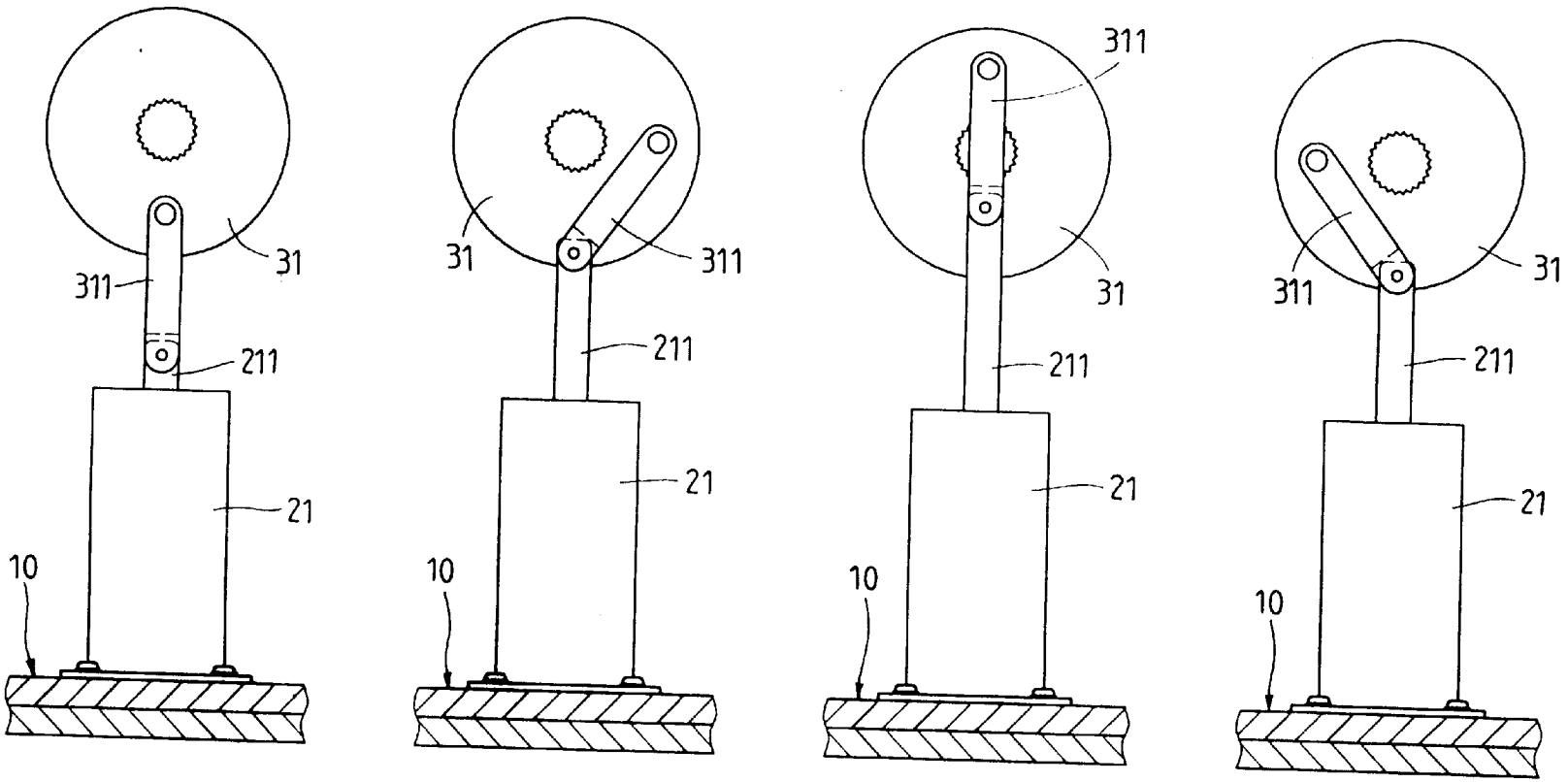
FIG. 6 shows consecutive movements of the output shaft of the activation member and the disk driven by the output shaft.
Figure 7:
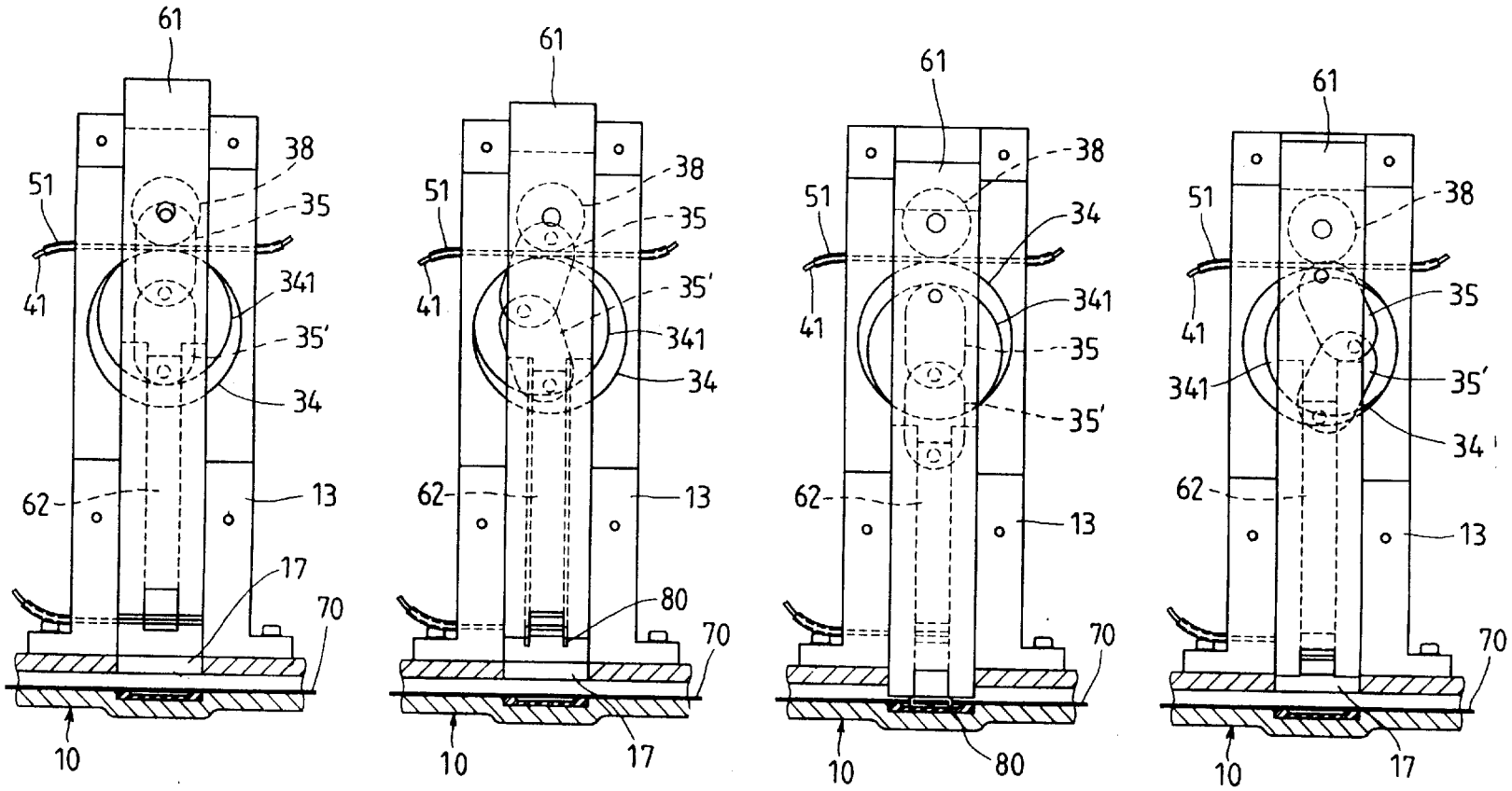
FIG. 7 shows consecutive movements of the ejecting member driven by the action members output shaft of the activation members.

Referring to FIG. 6, when the activation member 21 is activated by the activation of the switch 16 when the document 70 contacts the switch 16, the output shaft 211 is moved to rotate the disk 31 by the link 311. The metal wire 41 is periodically fed by the outer periphery of the eccentric disk 341 of the first roller 34. The leading end of the metal wire 41 extends transversely through the groove 131. While the first roller 34 and the second roller 38 rotate, the two action members 35, 35' is activated as shown in FIG. 7 and the staple-bending member 61 and the ejection member 62 are respectively lowered. The two protrusions 612 bend the section of the metal wire 41 in the groove 131 to be two legs of a staple and the ejecting member 62 is lowered to eject the staple 80 from the aperture 17 to staple the document. The first slit 631 and the second slit 622 assist the metal wire 41 in position so that the staple-bending member 61 successfully makes the staple 80. The staples 80 are made from a metal wire 41 so that the users need not to re-load the staples frequently.

While we have shown and described the embodiment in accordance with the present invention, it should be clear to those skilled in the art that further embodiments may be made without departing from the scope of the present invention.

What is claimed is:

1. An electric stapling device comprising:

a casing having a platform connected to a lower end thereof and a slot defined between the casing and the platform, an aperture defined through the lower end of the casing and communicating with the slot, a switch located in the slot, an activation member received in the casing and a link pivotally connected to an output shaft of the activation member;

a base located in the casing and a first shaft and a second shaft rotatably extending through the base, a disk securely connected to the first shaft and a first rod extending from the disk at a distance from the center of the disk, the first rod pivotally connected to the link, a first gear mounted to the first shaft and engaged with a second gear mounted to the second shaft, a first roller mounted to the first shaft and engaged with a second roller mounted on the second shaft, a staple-bending member movably connected to the base and having two protrusions extending from a lower end thereof, a groove defined in the base and an ejecting member movably received in the groove and located between the base and the staple-bending member, the ejecting member located in alignment with the aperture of the casing;

a second rod extending from the first roller at a distance from the center of the first roller, a first action member having a first end pivotally connected to the staple-bending member and a second end of the first action member mounted on the second rod, a second action member having a first end thereof mounted to the second rod and a second end of the second action member pivotally connected to a first end of the ejection member, and a mandrel connected to the casing and a metal wire wrapped around the mandrel, the metal wire extending between the first roller and the second roller and extending transversely through the groove.

2. The stapling device as claimed in claim 1, wherein the base has a recess which communicates with the groove and a spring and a block are received in the recess, the block having an inclined surface and a first slit in which the metal wire is engaged, a second slit defined in a second end of the ejection member.

3. The stapling device as claimed in claim 1, wherein the first roller has an eccentric disk and a portion of an outer periphery of the eccentric disk contacts the metal wire periodically when the first roller rotates.

* * * * *